US005765513A

United States Patent [19]

Diehl et al.

[11] Patent Number: 5,765,513

[45] Date of Patent: Jun. 16, 1998

[54] ELECTROMECHANICALLY ACTUATED VALVE

[75] Inventors: Roy Edward Diehl, Northville; Feng Liang, Canton; John Michael Miller, Saline; Xingyi Xu, Canton, all of Mich.

[73] Assignee: Ford Global Technologies, Inc., Dearborn, Mich.

[21] Appl. No.: 746,592

[22] Filed: Nov. 12, 1996

[51] Int. Cl.[6] ..... F01L 9/04

[52] U.S. Cl. ..... 123/90.11; 251/129.01; 251/129.16; 251/129.18

[58] Field of Search ..... 123/90.11, 90.15; 251/129.01, 129.05, 129.1, 129.15, 129.16, 129.18; 335/256, 258, 266, 268

[56] References Cited

U.S. PATENT DOCUMENTS

| | | | |
|---|---|---|---|
| 4,455,543 | 6/1984 | Pischinger et al. | 335/266 |
| 4,515,343 | 5/1985 | Pischinger et al. | 123/90.11 |
| 4,682,574 | 7/1987 | Kreuter | 123/90.11 |
| 4,715,330 | 12/1987 | Buchl | 123/90.11 |
| 4,715,332 | 12/1987 | Kreuter | 123/90.11 |
| 4,719,882 | 1/1988 | Kreuter | 123/90.11 |
| 4,777,915 | 10/1988 | Bonvallet | 123/90.11 |
| 4,831,973 | 5/1989 | Richeson, Jr. | 123/90.11 |
| 5,070,826 | 12/1991 | Kawamura | 123/90.11 |
| 5,074,259 | 12/1991 | Pusic | 123/90.11 |
| 5,095,856 | 3/1992 | Kawamura | 123/90.11 |
| 5,115,772 | 5/1992 | Kawamura | 123/90.11 |
| 5,131,624 | 7/1992 | Kreuter et al. | 251/129.18 |
| 5,222,714 | 6/1993 | Morinigo et al. | 251/129.16 |

FOREIGN PATENT DOCUMENTS

1121469 A 10/1984 U.S.S.R. .

OTHER PUBLICATIONS

Control of Engine Load via Electromagnetic Valve Actuators, SAE 94–0816, The Engineering Society for Advancing Mobility Land Sea Air and Space, Feb. 28–Mar. 3, 1994.

*Primary Examiner*—Weilun Lo
*Attorney, Agent, or Firm*—Donald A. Wilkinson

[57] ABSTRACT

An electromechanically actuated valve (12) for use as an intake or exhaust valve in an internal combustion engine. The valve (12) is actuated by a electromechanical actuator assembly (18) which includes a first electromagnet (22), second electromagnet (30) and third electromagnet (32). A first disk (38) is fixedly mounted to the valve (12) in a gap between the first and second electromagnets, and a second disk (44) is slidably mounted to the valve (12) above the third electromagnet (32) with a stop member (40) limiting its travel toward the first disk (38). With the valve (12) being in a closed position, the gap between the first disk (38) and the first electromagnet (22) is greater than the gap between the second disk (44) and third electromagnet (32), allowing for multiple valve lifts. A first spring (48), mounted between the cylinder head (14) and first disk (38), and a second spring (50), mounted between the second disk (44) and an actuator housing (20), create an oscillatory system which drives most of the valve movement during engine operation, thus reducing power requirements to actuate the valves while increasing the responsiveness of the valves.

15 Claims, 2 Drawing Sheets

ELECTROMECHANICALLY ACTUATED VALVE

FIELD OF THE INVENTION

The present invention relates to electromechanically actuated valves, and more particularly to intake and exhaust valves employed in an internal combustion engine.

BACKGROUND OF THE INVENTION

Conventional engine valves (intake or exhaust) used to control the intake and exhaust in the cylinders of internal combustion engines, are controlled by camshafts that make the valve motion profile as a fixed function of the crankshaft position. While this may be generally adequate, it is not optimal, since the ideal intake and exhaust valve timing and lift vary under varying speeds and loads of the engine. Variable valve timing and lift can account for such conditions as throttling effect at idle, EGR overlap, etc., to substantially improve overall engine performance. Although some attempts have been made to allow for variable timing based upon adjustments in the camshaft rotation, this is still limited by the individual cam lobes themselves.

Consequently, some others have attempted to do away with camshafts altogether by individually actuating the engine valves by some type of electromechanical or electrohydraulic means. These systems have not generally proven successful, however, due to substantial costs, increased noise, reduced reliability, slow response time, and/or increased energy consumption of the systems themselves.

One type of electromechanical system attempted employs simple electromagnets for actuators. But these have proven inadequate because they do not create enough magnetic force for speed needed to operate the valves without an inordinate amount of energy input, particularly in light of the fact that the force profile is not desirable since the magnetic force increases as an armature disk approaches the electromagnet, creating slap at end of stroke (noise and wear concerns), but not much force for acceleration at the beginning of the stroke. Further, the release of an armature disk from an electromagnet is generally too slow for use as an engine valve due to the fact that the magnetic field takes some amount of time to decrease to zero after the current is turned off to that electromagnet.

U.S. Pat. No. 5,222,714 attempts to overcome some of the deficiencies of an electromagnetic system by providing a spring to create an oscillating system about a neutral point wherein the springs are the main driving force during operation, and electromagnets provide holding forces in the opened and closed position, while also making up for frictional losses of the system. However, this system is still not able to fully utilize the possible efficiencies of the engine. A major drawback is that although this system allows for extensive control of valve timing, it is limited as with the conventional camshaft systems to a single valve lift distance, thus not fully taking advantage of engine efficiencies that can be had.

Hence, a simple, reliable, fast yet energy efficient actuator for engine valves is desired, with the flexibility to vary both valve timing and lift to substantially improve engine performance.

SUMMARY OF THE INVENTION

In its embodiments, the present invention contemplates an engine valve assembly for an internal combustion engine having a cylinder head. The engine valve assembly includes an engine valve having a head portion and a stem portion, adapted to be slidably mounted within the cylinder head, and an actuator housing adapted to be mounted to the cylinder head and surrounding a portion of the valve stem. A first electromagnet is fixedly mounted relative to the actuator housing, encircling a portion of the valve stem, and a second electromagnet is fixedly mounted relative to the actuator housing, encircling a portion of the valve stem farther from the head of the engine valve than the first electromagnet and spaced from the first electromagnet. A third electromagnet is fixedly mounted relative to the actuator housing, encircling a portion of the valve stem farther from the head of the engine valve than the second electromagnet. A first disk is fixedly mounted to the engine valve stem and located between the first and second electromagnet, and a second disk is slidably mounted to the engine valve stem and located farther from the valve head than the third electromagnet. The valve assembly also includes first biasing means for biasing the first disk toward the second electromagnet, second biasing means for biasing the second disk toward the third electromagnet, and means for limiting the sliding of the second disk along the valve stem toward the first disk and allowing for a different distance between the second disk and third electromagnet than between the first disk and first electromagnet.

Accordingly, an object of the present invention is to provide an electromechanically actuated engine valve having variable timing and lift which is capable of operating at speeds required by internal combustion engine operation.

An advantage of the present invention is that the electromechanical engine valve creates an oscillating system which traps energy in the opened or closed positions for release during transient conditions, and which also provides for softer landings of the valve, thus reducing noise and wear generated between the valve and actuator.

DETAILED DESCRIPTION OF THE PREFERRED EMBODIMENTS

Figure 1:
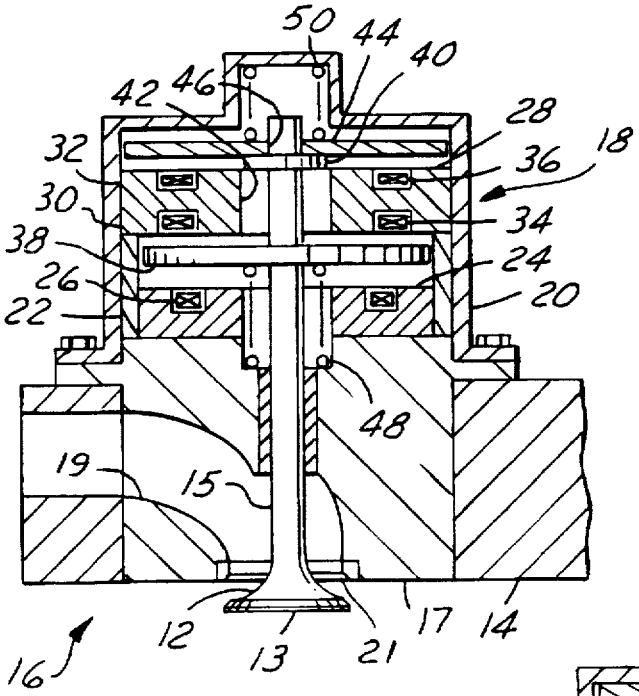
FIG. 1 is a Schematic view of an engine valve assembly, with the valve in a neutral position, in accordance with the present invention.

FIGS. 1–4 illustrate a first embodiment of the present invention. An engine valve 12, intake or exhaust as the case may be, is slidably mounted within an insert 17, secured in a cylinder head 14 of an internal combustion engine 16. The insert 17 and cylinder head 14 define a port 19, again either intake or exhaust, and a valve seat 21. The insert 17 allows for easier assembly of components into the cylinder head 14, and later servicing, as a module, but if preferred, the insert portion can be integral with the head.

The engine valve 12 includes a head portion 13, which seats against the valve seat 21 in its closed position, and a stem portion 15. This engine valve 12 controls the fluid flow into or out of a cylinder (not shown) within the engine 16.

An electromechanical actuator assembly 18 engages the valve stem portion 15 and drives the engine valve 12. The actuator assembly 18 includes a housing 20 mounted to the cylinder head insert 17, or cylinder head 14, if so desired. Within the housing 20 is mounted a first electromagnet 22, which is fixed relative to the housing 20. The first electromagnet 22 includes an annulus shaped core member 24, made of a magnetically conductive material, encircling a portion of the valve stem 15. The first electromagnet 22 also includes a first coil 26, extending circumferentially through the core member 24 forming an annulus shape near the upper surface of the core member 24.

A second annulus shaped core member 28, made of a magnetically conductive material, is also fixed relative to the housing 20 and forms portions of a second electromagnet 30 and a third electromagnet 32. A second coil 34 extends circumferentially through the second core member 28 forming an annulus shape near the lower surface of the second core member 28, forming a part of the second electromagnet 30. A third coil 36 also extends circumferentially through the second core member 28 forming an annulus shape, but near the upper surface of the second core member 28, forming a part of the third electromagnet 32. The three coils are connected to a conventional source of electrical current (not shown), which can be selectively turned on and off to each one independently by a conventional type of controller, such as an engine computer (not shown).

Mounted to the valve stem 15 is a first annular disk 38, which is fixed relative to and moves with the stem 15. This first disk 38 is located between the upper surface of the first electromagnet 22 and the lower surface of the second electromagnet 30. Also mounted and fixed relative to the valve stem 15 is a stop member 40. The stop member 40 has an outer diameter that is small enough to allow the stop 40 to slide into a circular passage 42 through the center of the second core 28. A second annular disk 44 is mounted about the valve stem 15 above the stop member 40. The second disk 44 includes a central circular hole 46, which has a smaller diameter than the outer diameter of the stop member 40, but a larger diameter than the valve stem 15. This allows for relative sliding movement between the second disk 44 and the valve stem 15, but only above the stop member 40.

Figure 2:
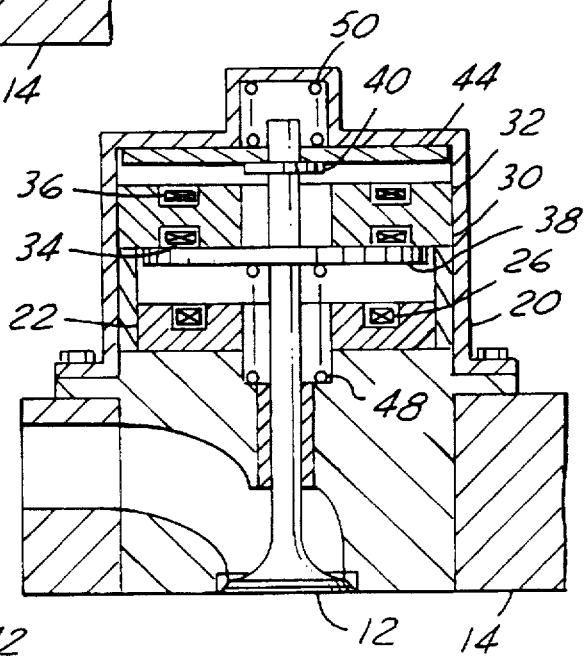
FIG. 2 is a schematic view similar to FIG. 1, but with the engine valve in its closed position.

In order to allow for two lift distances of the engine valve 12, the gap created between the top surface of the first electromagnet 22 and the bottom surface of the first disk 38 is greater than the gap created between the top surface of the third electromagnet 32 and the bottom surface of the second disk 44, when the engine valve 12 is in its closed position (FIG. 2). The difference in the width of the gaps determines the difference in height between the two valve open positions.

A first spring 48 is mounted between the cylinder head insert 17 and the bottom surface of the first disk 38, and a second spring 50 is mounted between the top surface of the second disk 44 and the actuator housing 20. The springs 48 and 50 are biased such that each counteracts the force of the other to cause a neutral or resting position of the engine valve 12 to be at a partially opened position, as shown in FIG. 1. This resting position occurs, for instance, when the engine 16 is not operating, and thus, the electromagnets are not activated. By having this partially open resting position, an oscillating system can be created by the two springs during engine valve operation to store some of the energy in the springs and return it to the system.

The operation of the electromechanical actuator 18 and resulting valve motion will now be described. To initiate valve closing, the coil 34 in the second electromagnet 30 is energized, causing the first disk 38 to be pulled upward towards it, and also causing the second disk 44 to compress the second spring 50. Engine valve 12, as a result, is pulled to its closed position, as is illustrated in FIG. 2. The second electromagnet 30 stays energized to hold this position against the bias of the second spring 50. The compressed spring 50 now possesses potential energy for the oscillating system which will drive most of the engine valve movement during engine operation.

Figure 5:
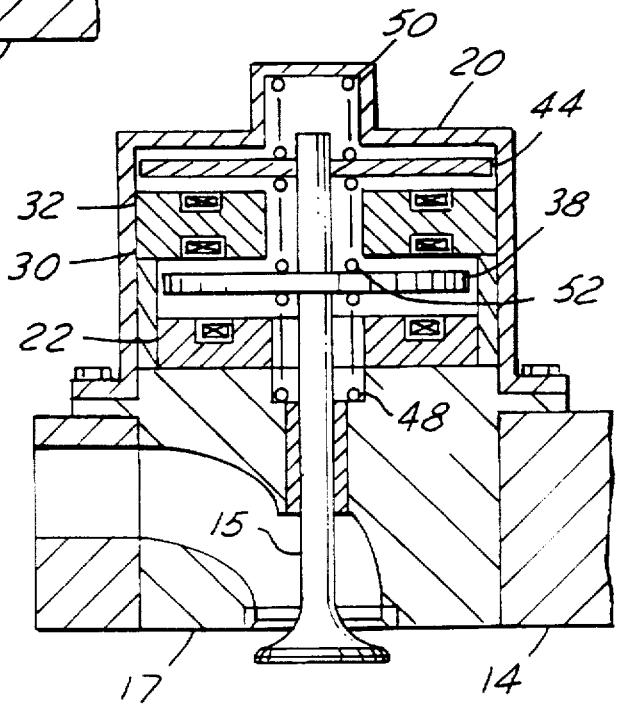
FIG. 5 is a Schematic view of an engine valve assembly similar to FIG. 1, but illustrating an alternate embodiment of the present invention.

To begin to open the engine valve 12, the second electromagnet 30 is de-energized, allowing the second spring 50 to push the second disk 44 downward, which in turn, pushes against the stop member 40, causing the valve 12 to begin opening. To open the engine valve 12 to the mid-opened position and hold it there, the third coil 36 is energized, causing the second disk 44 to be pulled downward towards it and held by magnetic force. As a result of this, the first disk 38 to compress the first spring 48. The third coil 36 stays energized to hold the engine valve 12 in the mid-open position against the bias of the first spring 48, as is illustrated in FIG. 5. The mid-open position can be any fraction of the full open position depending upon the characteristics and operating conditions of the particular engine.

In order to further increase the response speed of the system, the direction of current in the third coil 36 is preferably chosen to be against the current in the second coil 34 so that the magnetic fluxes produced by the two currents act against each other. In this way, the flux density of between the second coil 34 and the first disk 38 is reduced, which reduces the holding force, thus increasing the initial opening speed.

The oscillating type of system described herein creates a situation where the work done by the electromagnets is mostly used to hold the valve 12 in a particular position, while most of the work of moving the valve 12 is done by the springs. Only a small portion of the work of moving the valve 12 is done by the electromagnets, to make up for friction effects and other energy losses within the system. In this way, the energy needed for this electromagnetic actuator 18 to drive the valve 12 is minimized.

Figure 3:
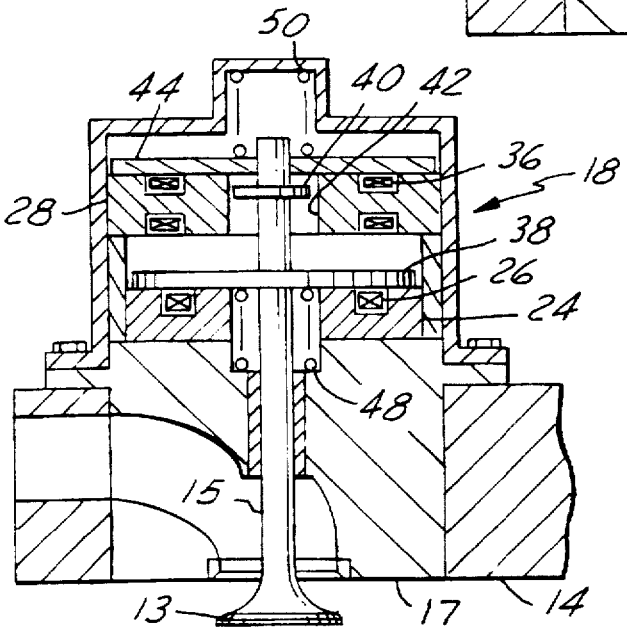
FIG. 3 is a schematic view similar to FIG. 1, but with the engine valve in its fully open position.
Figure 4:
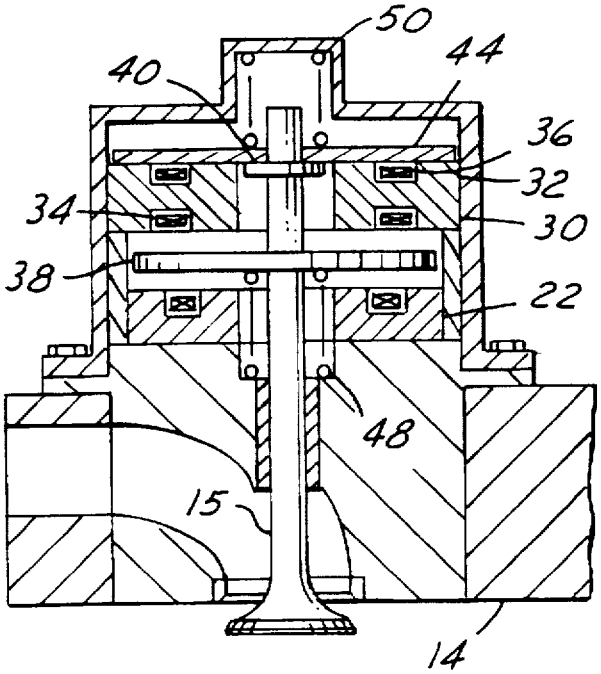
FIG. 4 is a schematic view similar to FIG. 1, but with the engine valve in its mid-open position.

In order to open the engine valve 12 to its full open position from the closed position, the same procedure is followed as with the mid-open position, with the exception that the first coil 26 is energized instead of the third coil 36. The first disk 38 is then held against the first electromagnet 22, as illustrated in FIG. 3. The second disk 44 does not prevent this full lift motion since once it contacts the second core 28, the valve stem 15 and stop member 40 can still travel downward relative to it. As an alternate operating method for full valve opening, during the initial stages of valve opening, the third coil 36 may be energized for a brief period, along with the first coil 26, to increase the speed of the valve opening.

To close the valve 12 from the mid-open or full open positions, the first coil 26 or the third coil 36, as the case may be, is de-energized, allowing the first spring 48 to push the engine valve 12 upward. The second coil 34 is energized to pull the first disk 38 upward and hold the engine valve 12 in its closed position, again as illustrated in FIG. 2.

By utilizing the resonance of the two springs in the actuator 18 to accomplish much of the movement, the response time is improved over merely providing electromagnets, and with less power consumption. Further, the springs allow for a system with softer landings, since one of the springs is always acting against the valve motion, than a pure electromagnet actuated system, thus reducing the noise and wear that otherwise may occur. The two valve lift positions are also determined by simple on/off commands of the electromagnets rather than attempting to precisely adjust and control the electric current used to power the magnets or other complex means that may be used to create mid-open or full open positions.

An alternate embodiment of the present invention is illustrated in FIG. 5. A third spring 52 replaces the stop member 40 of FIG. 1. The third spring 52 is mounted between the top surface of the first disk 38 and the lower surface of the second disk 44. This embodiment operates in generally the same way as in the first embodiment, with the advantage being that it may operate somewhat quieter in that the second disk 44 and stop member 40 of the first embodiment which can create some noise when they contact one another during a valve closing event, will no longer occur.

While certain embodiments of the present invention have been described in detail, those familiar with the art to which this invention relates will recognize various alternative designs and embodiments for practicing the invention as defined by the following claims.

We claim:

1. An engine valve assembly for an internal combustion engine having a cylinder head, the engine valve assembly comprising:

an engine valve having a head portion and a stem portion, adapted to be slidably mounted within the cylinder head;

an actuator housing adapted to be mounted to the cylinder head and surrounding a portion of the valve stem;

a first electromagnet, fixedly mounted relative to the actuator housing and encircling a portion of the valve stem;

a second electromagnet, fixedly mounted relative to the actuator housing and encircling a portion of the valve stem farther from the head of the engine valve than the first electromagnet and spaced from the first electromagnet;

a third electromagnet, fixedly mounted relative to the actuator housing and encircling a portion of the valve stem farther from the head of the engine valve than the second electromagnet;

a first disk fixedly mounted to the engine valve stem and located between the first and second electromagnet;

a second disk slidably mounted to the engine valve stem and located farther from the valve head than the third electromagnet;

first biasing means for biasing the first disk toward the second electromagnet;

second biasing means for biasing the second disk toward the third electromagnet; and means for limiting the sliding of the second disk along the valve stem toward the first disk and allowing for a different distance between the second disk and third electromagnet than between the first disk and first electromagnet when the engine valve is in a closed position.

2. The engine valve assembly of claim 1 wherein the first biasing means is a spring adapted to be mounted between the first disk and the cylinder head.

3. The engine valve assembly of claim 2 wherein the second biasing means is a second spring mounted between the second disk and the actuator housing.

4. The engine valve assembly of claim 3 wherein the means for limiting the sliding is a stop member fixedly mounted to the engine valve stem, located between the first disk and the second disk and shaped to limit the sliding travel of the second disk along the valve stem toward the first disk.

5. The engine valve assembly of claim 3 wherein the means for limiting the sliding is a spring mounted about the valve stem between the first disk and second disk.

6. The engine valve assembly of claim 1 wherein the second biasing means is a spring mounted between the second disk and the actuator housing.

7. The engine valve assembly of claim 1 wherein the means for limiting the sliding is a stop member fixedly mounted to the engine valve stem, located between the first disk and the second disk and shaped to limit the sliding travel of the second disk along the valve stem toward the first disk.

8. The engine valve assembly of claim 1 wherein the means for limiting the sliding is a spring mounted about the valve stem between the first disk and second disk.

9. The engine valve assembly of claim 1 wherein the second electromagnet comprises a portion of a core member, having a first surface facing the first disk and a first coil mounted within the core near the first surface, and wherein the third electromagnet comprises a different portion of the core member having a second surface facing the second disk, and a second coil mounted within the core near the second surface.

10. The engine valve assembly of claim 9 wherein any electrical current which would flow in the first coil opposes any current which would flow in the second coil.

11. An internal combustion engine for use in a vehicle comprising:

a cylinder head mounted to the engine;

an engine valve having a head portion and a stem portion slidably mounted within the cylinder head;

an actuator housing mounted to the cylinder head and surrounding a portion of the valve stem;

a first electromagnet, fixedly mounted relative to the actuator housing and encircling a portion of the valve stem;

a second electromagnet, fixedly mounted relative to the actuator housing and encircling a portion of the valve stem farther from the head of the engine valve than the first electromagnet and spaced from the first electromagnet;

a third electromagnet, fixedly mounted relative to the actuator housing and encircling a portion of the valve stem farther from the head of the engine valve than the second electromagnet;

a first disk fixedly mounted to the engine valve stem and located between the first and second electromagnet;

a second disk slidably mounted to the engine valve stem and located farther from the valve head than the third electromagnet;

a spring mounted between the first disk and the cylinder head for biasing the first disk toward the second electromagnet;

a second spring mounted between the second disk and the actuator housing for biasing the second disk toward the third electromagnet; and means for limiting the sliding of the second disk along the valve stem toward the first disk and allowing for a different distance between the second disk and third electromagnet than between the first disk and first electromagnet when the engine valve is in a closed position.

12. The engine of claim 11 wherein the second electromagnet comprises a portion of a core member, having a first surface facing the first disk and a first coil mounted within the core near the first surface, and wherein the third electromagnet comprises a different portion of the core member having a second surface facing the second disk, and a second coil mounted within the core near the second surface.

13. The engine of claim 11 wherein the engine valve is an intake valve.

14. The engine of claim 11 wherein the engine valve is an exhaust valve.

15. The engine of claim 11 wherein the cylinder head comprises a valve cavity and an insert member mounted within the cavity, with the engine valve slidably mounted within the insert.

* * * * *